United States Patent [19]

Broady et al.

[11] Patent Number: 4,534,887

[45] Date of Patent: Aug. 13, 1985

[54] MOLDED-TO-SIZE SILVER-GRAPHITE ARTICLES AND PROCESS FOR MAKING SAME

[75] Inventors: Floyd J. Broady, Taylors; J. Rondal Jasek, Greenville, both of S.C.

[73] Assignee: Union Carbide Corporation, Danbury, Conn.

[21] Appl. No.: 516,233

[22] Filed: Jul. 22, 1983

[51] Int. Cl.[3] ..... H01B 1/04

[52] U.S. Cl. ..... 252/503; 252/506; 264/29.5; 264/29.6; 264/29.7; 264/105

[58] Field of Search ..... 252/503, 506, 510; 264/105, 29.1, 29.5, 29.6, 29.7; 310/253

[56] References Cited

U.S. PATENT DOCUMENTS

| | | | |
|---|---|---|---|
| 2,448,685 | 9/1948 | Ramadanoff | 252/503 |
| 2,640,944 | 6/1953 | Ramadanoff | 252/503 |
| 2,715,080 | 8/1955 | Cashell | 252/506 |
| 2,934,460 | 4/1960 | Ramadanoff | 117/228 |
| 2,980,633 | 4/1961 | Koehler et al. | 252/506 |
| 3,146,130 | 8/1964 | Kroger et al. | 136/34 |
| 3,165,480 | 1/1965 | Churchill | 252/503 |
| 3,442,787 | 5/1969 | Landrum et al. | 252/506 |
| 4,046,863 | 9/1977 | Kobayashi et al. | 252/502 |
| 4,188,279 | 2/1980 | Yan | 252/506 |
| 4,220,884 | 9/1980 | Sternbergh | 310/251 |

*Primary Examiner*—Josephine L. Barr

*Attorney, Agent, or Firm*—Cornelius F. O'Brien

[57] ABSTRACT

Disclosed is a process for introducing elemental silver in graphite by blending a silver compound with graphite, mixing the same with dissolved pitch to form a mix, shaping the mix to any desired shape and size and baking at high temperature to form the finished article which contains a uniformly distributed and predictable silver level.

9 Claims, No Drawings

MOLDED-TO-SIZE SILVER-GRAPHITE ARTICLES AND PROCESS FOR MAKING SAME

FIELD OF THE INVENTION

Graphite brushes and contacts are sometimes made with silver powder or are sometimes impregnated with silver to decrease their contact resistance or to decrease their specific resistance. The subject invention is a process for the manufacture of such brushes or contacts which improves the uniformity and predictability of the silver level in the product by introducing the silver as a silver compound with the graphite filler and reducing the silver compound to elemental silver prior to mixing the filler with the binder.

PATENT BACKGROUND

The patent art evidences activity in this area and this discussion will be limited to the most relevant patents. Thus U.S. Pat. No. 3,146,130 teaches the impregnation of porous electrodes with a solution of an ammonium complex silver prepared by dissolving a silver compound in a nitrogen-containing solvent and heating to evaporate the solvent. U.S. Pat. No. 2,934,460 to Ramadanoff concerns a method for impregnating carbonaceous brushes with silver and silver sulfide in a precipitate such as acetone or ethylene diamine; heating to precipitate silver nitride in situ rapidly and then further heating the brush to reduce the silver nitrate to silver. U.S. Pat. No. 4,220,884 describes a method of making a carbon contact brush by melting a metal such as tin or an alloy thereof with lead, zinc and silver; immersing a porous carbon body therein to impregnate it with molten metal and removing the body from the molten metal to solidify the metal therewithin.

None of these patents suggest or hint at the incorporation of the metal with graphitic particles and pitch prior to shaping and cannot produce the same articles.

SUMMARY OF THE INVENTION

A simplified flow diagram of the present is as follows:

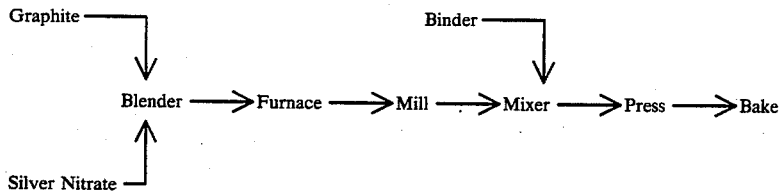

In accordance with this invention, graphite and silver nitrate are blended together and heated to an elevated temperature of 600° to 800° C. or to where the silver nitrate is converted to metallic silver. The mixture of silver-graphite is milled and combined with a binder and a solvent in a mixer. This blend is milled and molded into desired shapes and baked. The raw materials can be mixed in any proportions to obtain the desired product of silver in the product.

DISCLOSURE OF THE BEST MODE

A particular use of the present process is for making silver-graphite contacts. The silver-graphite contacts universally used in the field today contain a 50–55% silver level. However, other silver levels ranging from 1% to 99% can be achieved by altering the formulations used in this process. Thus if one combines 153 grams of silver nitrate with 50 grams of graphite, follows the processing steps, and adds 28 grams of pitch binder per 70 grams of silver-graphite, then the process will yield a brush with approximately 50% silver by weight. Proceeding similarly with adjusted levels of the components yielded silver levels of 28%, 37%, 44%, 52%, and 55%.

Various solvents such as trichlorethylene, methylene chloride, toluene, mixtures thereof and other aromatic hydrocarbons can be used to dissolve the pitch. Silver nitrate is the preferred silver-containing compound but others may be used as well such as silver acetate, silver carbonate, and silver-protein complexes. Any graphite material natural or artificial can be used. Similarly a wide range of pitch binders can be used.

All reactions described in this process are time-temperature related and can be altered to suit a particular need.

The screening process following a final 3-hour, 160° C.–170° C. temperature treatment is particularly important to the uniformity of the final material as it reduces the silver particle agglomeration. However, other screen sizes can be used to obtain any product desired.

This material can be baked at temperatures ranging from 600° C. to 1400° C. to obtain the desired physical properties.

The invention is further illustrated in a non limiting fashion by the following examples.

EXAMPLE 1

The following procedure produces a 50–55% by weight silver contact or brush.

Intimately mix 153 grams of silver nitrate (crystals, powder, or in aqueous solution) and 50 grams of graphite in a container. Mill the mixture to a fine powder. Place the powder in a sagger lined with Grafoil flexible graphite, place a lid on the sagger, fire the contents in an inert atmosphere in a Lindberg furnace at 700° C. for 3 hours. Grafoil is a trademark of Union Carbide Corporation. Mill the resulting silver-graphite mixture and weigh this powder to determine the amount of "available silver-graphite". Place one gram of pitch per 2.5 grams available silver-graphite into a beaker. Add 500 milliliters of trichlorethylene to the pitch and stir the slurry until the pitch has dissolved. Add the silver-graphite to the pitch solution and stir until a smooth slurry is formed. Continue mixing for 45 minutes.

Pour this slurry into evaporating pans. Keep the slurry stirred while pouring into the pans. Place the pans into a 90° C. oven until all volatiles have been evaporated (approximately 1 to 2 hours). Let the mix cool. Crush the mix into small pieces (½" diameter maximum). Place the crushed mix into drying pans and place in a 160° C. to 170° C. oven for 3 hours. Let the mix cool. Mill the mix in a swing hammer mill to a fine powder of around 200 mesh and place in the drying pans. Place the pans in a 160° C. to 170° C. oven for 3 hours. Mill the mix in a swing hammer mill to a fine powder and screen through a 200 mesh screen. The portion of mix not going through 200 mesh may be remilled and rescreened. The screened mix is heat treated at 150° C. to 250° C. for 15 minutes and granulated in a Stokes Granulator through a 50 mesh screen. Then the granulates are molded in a press such as a Dorst Press. Pressures developed during the pressing operation may be in the range of 5 to 15 tons per square inch, or even higher. The molded shape then is baked in a Lindberg furnace at 1000° C. to 1200° C. under an inert atmosphere before machining to finished size and X-ray inspection.

In other examples of the invention the following contacts were made as in Example 1 and had the indicated characteristics.

EXAMPLE 2

The finished contacts contained 28% silver and had an average compressive strength of 5500 psi with an average density of 1.77 g/cm$^3$ and a specific resistance of 0.0016 ohm inches.

EXAMPLE 3

The contacts contained 37% silver, had an average compressive strength of 12,000 psi with an average density of 2.29 g/cm$^3$ and a specific resistance of 0.0011 ohm inches.

EXAMPLE 4

The contacts contained 44% silver, had an average compressive strength of 15,500 psi with an average density of 2.72 g/cm$^3$ and a specific resistance of 0.0012 ohm inches.

EXAMPLE 5

The contacts contained 52% silver, had an average compressive strength of 14,580 psi with an average density of 3.00 g/cm$^3$ and a specific resistance of 0.00095 ohm inches.

X-ray examination showed these pieces had excellent silver distribution.

While there have been described herein what are at present considered preferred embodiments of the invention, it will be obvious to those skilled in the art that minor modifications and changes may be made without departing from the essence of the invention. It is therefore to be understood that the exemplary embodiments are illustrative and not restrictive to the invention, the scope of which is defined in the appended claims and that all modifications that come with the meaning and ranges of equivalency of the claims are intended to be included therein.

What is claimed is:

1. A process for producing a molded graphite-silver article containing silver particles uniformly distributed throughout said article comprising the steps of:

(a) mixing graphite particles with a silver containing compound selected from the group consisting of silver nitrate, silver acetate, silver carbonate and silver protein complexes;

(b) heating said mixture to reduce said silver compound to metallic silver;

(c) milling the resulting product and mixing it with a pitch binder and a solvent to produce a slurry;

(d) removing volatiles from said slurry and milling the residue;

(e) molding the residue of step (d) to produce a dense body of a desired shape; and (f) heating said body in an inert atmosphere to carbonize the pitch binder and convert the body into said molded graphite-silver article.

2. The process of claim 1 wherein said silver-containing compound in step (a) is silver nitrate.

3. The process of claim 1 wherein said silver-containing compound is used in crystal, powder or solution form.

4. The process of claim 1 wherein said solvent in step (c) is selected from the group consisting of trichlorethylene, methylene chloride, toluene and mixtures thereof.

5. The process of claim 1 wherein the following step is added:

(g) machining said molded graphite-silver-article of step (f) to a desired size.

6. The process of claim 1 wherein in step (d) the milled residue is heated from 160° C. to 170° C. whereupon it is then cooled, further milled and reheated from 150° C. to 250° C. and then further milled.

7. The process of claim 1 wherein in step (f) the molded graphite-silver article is heated under an inert atmosphere at a temperature between 600° C. and 1400° C.

8. The process of claim 1 wherein the molded graphite-silver article contains from 28 to 55 percent by weight of silver.

9. The process of claim 1 wherein in step (c) about one gram of pitch per 2.5 grams of available silver-graphite is employed.

* * * * *